United States Patent [19]

Verstraten

[11] Patent Number: 4,953,611

[45] Date of Patent: Sep. 4, 1990

[54] PARTITION WALL CONSISTING OF DOUBLE-WALLED PANELS COUPLED PIVOTALLY TO EACH OTHER

[75] Inventor: Markus F.J. Verstraten, Maasbree, Netherlands

[73] Assignee: Pella B.V., Netherlands

[21] Appl. No.: 334,447

[22] Filed: Apr. 7, 1989

[30] Foreign Application Priority Data

Apr. 11, 1988 [NL] Netherlands ..... 8800936

[51] Int. Cl.[5] ..... E05D 15/12

[52] U.S. Cl. ..... 160/199; 160/190

[58] Field of Search ..... 160/199, 190, 206, 118; 49/125, 127; 52/64, 71

[56] References Cited

U.S. PATENT DOCUMENTS

| | | | |
|---|---|---|---|
| 1,626,764 | 5/1927 | Thorne | 160/199 |
| 2,514,370 | 7/1950 | Bunnell | 160/190 |
| 3,380,506 | 4/1968 | Good et al. | 160/199 X |
| 3,389,741 | 6/1968 | Bean | 160/199 |
| 3,448,786 | 6/1969 | Edgerton | 160/199 |
| 3,450,185 | 6/1969 | Holloway | 160/199 |
| 3,494,407 | 2/1970 | Hollands et al. | 160/199 |
| 3,979,861 | 9/1976 | Fromme et al. | 160/199 X |
| 4,106,544 | 8/1978 | Dixon et al. | 160/199 |

*Primary Examiner*—David M. Purol

*Attorney, Agent, or Firm*—Watson, Cole, Grindle & Watson

[57] ABSTRACT

The invention relates to a partition wall movable in an opening and consisting of double-walled panels coupled pivotally to each other at the standing edges, alternate panels being formed with a guide member attached fixedly to the panel and displaceable along a rail extending above the panels. An extension device in the form of a pin-like body which is slidable in an upper rail and which is continuously loaded by a force directed towards one of the standing hinged edges is provided. The partition wall is distinguished in that on the hinge edges two or more hinge assemblies are arranged, each provided with at least three parallel hinge pins and in each case with a pair of wings associated with each hinge portion. The partition wall further includes a panel wall whereby between the walls of each panel spacer elements are arranged.

18 Claims, 7 Drawing Sheets

PARTITION WALL CONSISTING OF DOUBLE-WALLED PANELS COUPLED PIVOTALLY TO EACH OTHER

BACKGROUND OF THE INVENTION

The invention relates to a partition wall movable in an opening and consisting of double-walled panels coupled pivotally to each other at the standing edges, alternate panels being formed with a guide member attached fixedly to the panel and displaceable along a rail extending above the panels.

Such partition walls are known in many embodiments, in particular that in which the walls of the panel are manufactured from sheet-like wooden material Especially in the case of large dimensions such panels are comparatively heavy. The mounting and transport from the factory to the place of use has thereby to be kept as simple as possible It is moreover preferable to have the panels, in the position where the opening is closed off, in as straight a line as possible with each other.

SUMMARY OF THE INVENTION

The invention has for its object to improve a panel wall of the above stated type relative to the known panels such that the above requirements are fulfilled in the simplest possible manner.

A partition wall according to the invention is distinguished in that at least one intermediate panel without a guide member disposed substantially at the center portion of the upper edge of the panel is embodied with extension means in the form of a pin-like body which is slidable in a upper rail and which is continuously loaded by a force directed towards one of the standing hinged edges.

This ensures that the extension of the panels can be carried out in a particularly simple manner, because when the partition wall is closed the pin-like body moves in the upper rail such that the intermediate panel which is freely swivellable between the adjacent panels is forced into a position parallel to the guide rail, with the result that the adjoining panels are also straightened.

In one embodiment the pin-like body is arranged on a slide situated close to the upper edge of the panel, which slide is preferably connected to a flexible member connected to a weight. Under the influence of gravity this weight will produce the desired adjusting force on the pin-like body.

The invention further provides a partition wall which is distinguished in that on the hinge edges two or more hinge assemblies are arranged, each provided with at least three parallel hinge pins and in each case with a pair of wings associated with each hinge portion, which wings extend in the folded retracted position of the panels at a right angle to these panels.

Such a hinge assembly has the advantage that the attachment of the adjacently positioned panels to one another, which are preferably placed beforehand in the guide rail, can take place in a simple manner by fastening the wings of the hinge portions to one another, these parts being in full sight and therefore easily accessible for fastening material such as screw bolts and the like.

In a preferred embodiment each hinge assembly is provided with seven hinge pins, whereby in each case two pairs of hinge wings are arranged which can be fastened to one another. Such an embodiment offers the advantage that the hinge is particularly robust and can be embodied without clearance, which contributes to a good force transfer, this being necessary in the extension of the panel wall.

The invention aims further to provide a panel wall whereby between the walls of each panel spacer elements are arranged, this spacer element according to the invention consisting of two portions, each attachable to a wall, which portion is provided with two body plates in staggered position relative to one another. Through correct mounting of the spacers on the walls of each panel, the walls only require mounting against one another with the spacer element portions, whereby the staggered body plates automatically come to lie against one another, which simplifies attachment by suitable attaching means.

Above mentioned and other features of the partition wall according to the invention will be further elucidated in the figure description given below of a number of embodiments.

DESCRIPTION OF THE PREFERRED EMBODIMENTS

Figure 1:
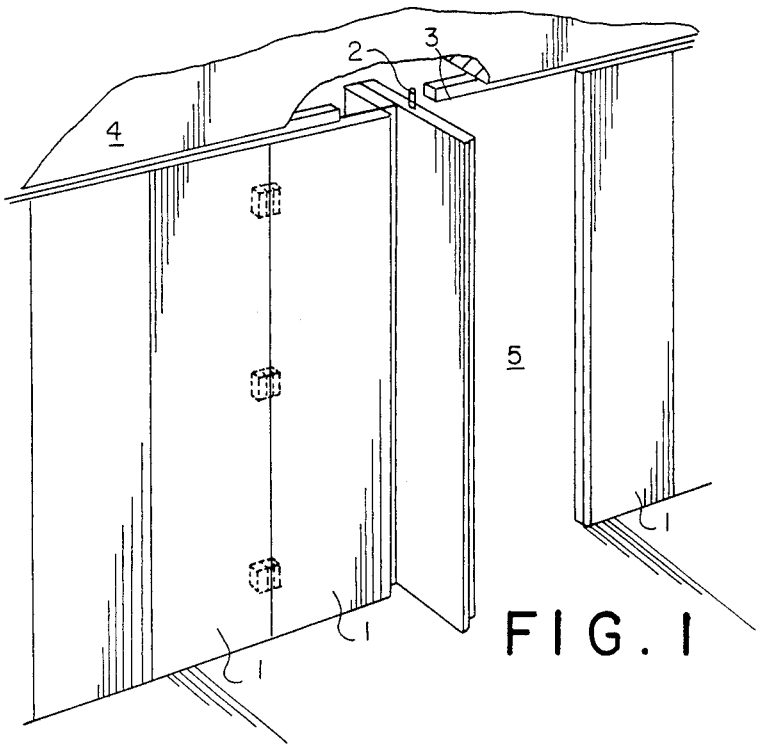
FIG. 1 shows a perspective top view of a partition wall according to the invention formed by panels and arranged in an opening.

The partition wall according to the invention consists in FIG. 1 of a number of adjacent standing panels 1 which will be further explained below with regard to their construction. Each panel has spaced opposite walls and includes upper and lower edges connected by opposite standing or side edges. The standing edges of the panels are hinge-connected to each other whereby alternate panels are provided with a guide member 2 disposed substantially at the center portion of the upper edge of each alternate panel and extending upwardly therefrom, guide member 2 being slidable in an upper rail 3. Rail 3 is provided with a downwardly facing slot 13 as seen in FIG. 3 which receives guide member 2 which as seen in FIG. 1 may comprise a pin-like body. The upper rail can be arranged in the construction of a building structure in any suitable manner. The height of the panels corresponds virtually with the height of the opening 5 in the building structure which has to be closed off by the partition wall. The width of the panels is normally of equal size, although end or intermediate panels can have a divergent width in order to achieve the required swivel action, see FIG. 2 and 3, the panel 1.

Figure 2:
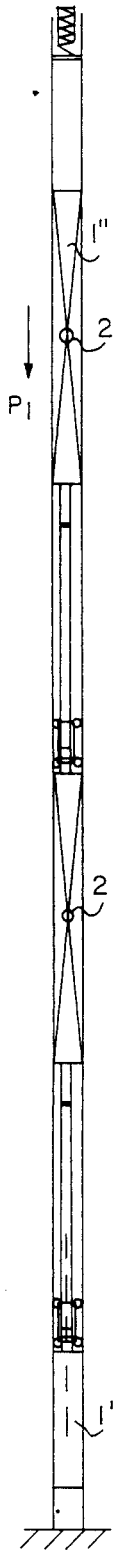
FIG. 2 and 3 show a top view of the panel wall from FIG. 1 in respectively the closed and open position of the door.
Figure 3:
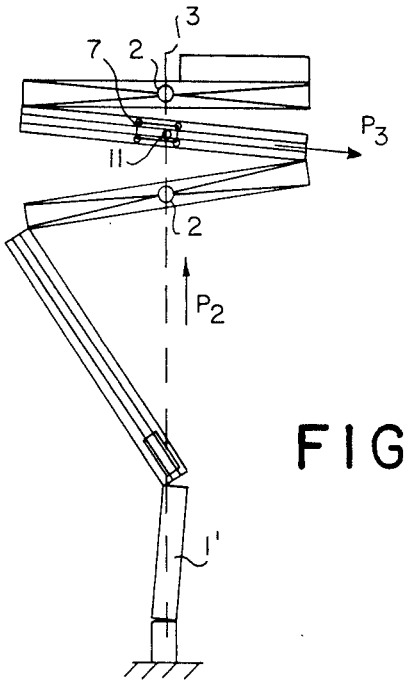

The hinge action of the partition wall can be seen in FIG. 2 and 3. Starting from the extended position in FIG. 1, whereby the panels lie in line with each other, the panel 1'' may be subjected to a particular pressing action in the direction of arrow $P_1$, with the result that the panels having the standing edges swivelling relative to one another brush against one another on the flat sides. The guide member 2 remains positioned in the rail 3 so that the centre of the panel remains under the rail 3. An exception is the panel 1' which swivels wholly outside the rail 3.

In the return movement from the open retracted to the closed extended position of the partition wall the panels must once again come to lie in line with each other, which causes problems because of the friction occurring as a consequence of the hinge friction and of the sealing members over the floor and ceiling. These sealing profiles are not themselves shown and are assumed to be known.

Figure 4:
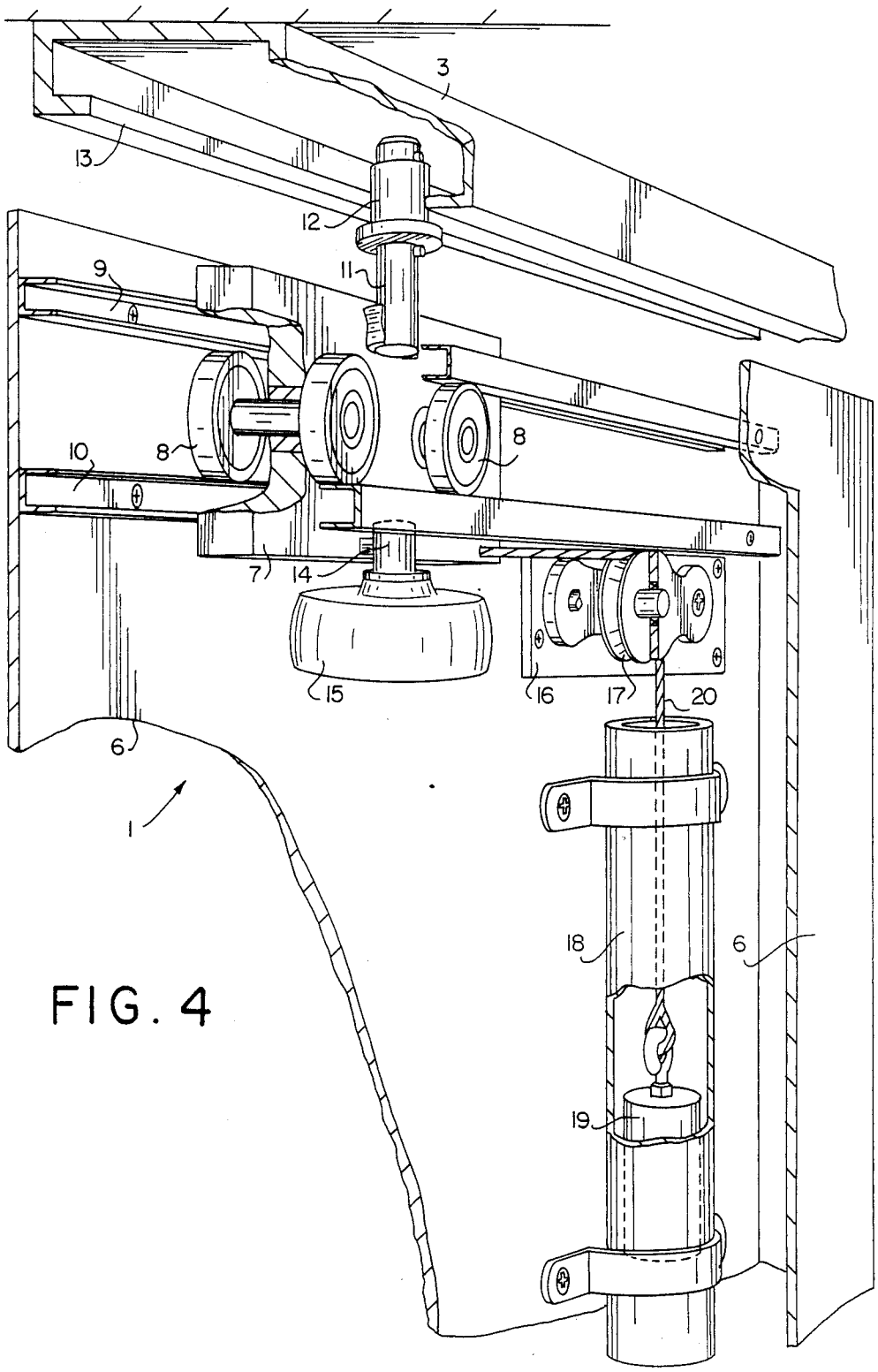
FIG. 4 is a perspective view of the upper portion of a panel from the panel wall provided with stretching means according to the invention.
Figure 5:
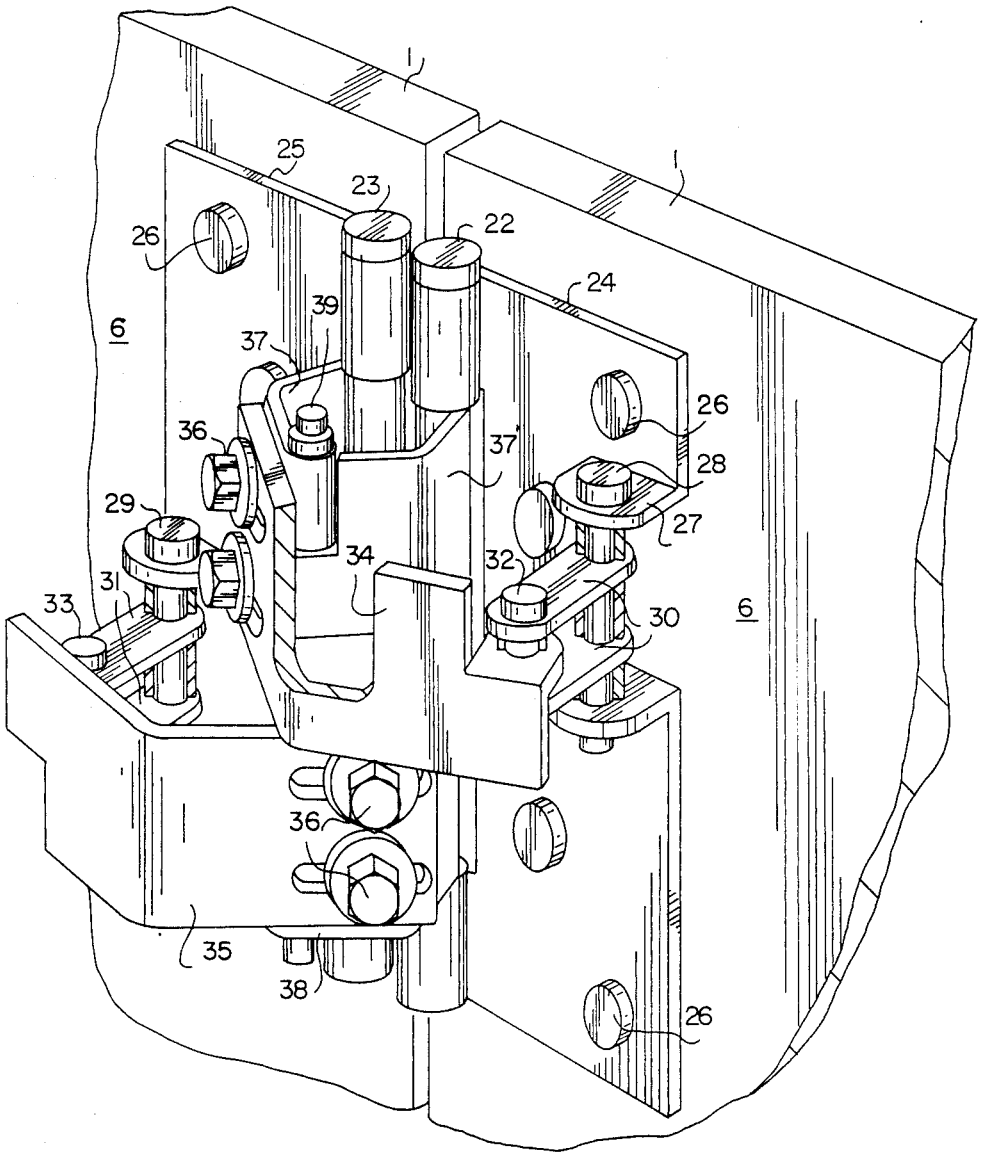
FIG. 5 is a perspective top view of a hinge construction between the panels of the wall according to the invention.

In order to facilitate the extending of the panels, means for this purpose are fitted which are further elucidated in FIG. 4.

Arranged between the two walls 6 of a panel, which consist of sheet material such as wood, is a slide 7 provided with two pairs of wheels 8 located at an interval from one another. These pairs of wheels are guided in upper and lower support members 9 and 10 in the form of channels having a generally U-shaped cross-sectional configuration arranged against the inside of the walls 6 and running parallel to respectively the top edge of walls 6 and the guide rail 3. The slide 7 carries an upward protruding pin 11, the free end of which is provided with a sleeve 12 rotatable relative thereto which is received within a slot 13 of guide rail 3. At the bottom the slide 7 is provided with a downward facing journal 14 carrying a guide wheel 15 which engages the inside of the walls 6.

Likewise arranged on the inner side of wall 6 is a bearing plate 16 onto which a guide wheel 17 is attached for rotation. The form as well as the manner of attachment of the guide wheel may be varied. Arranged beneath guide wheel 17 between both walls 6 is a tubular guide 18 in which a weight is freely vertically movable. A weight 19 is connected to a flexible member 20 which is trained over guide wheel 17 and is connected to slide 7.

The operation of the movable guide means is as follows. Starting from FIG. 3, when the door is pulled outward in the direction of the arrow P2 the guide members 2 will move along the rail 3, whereby the pin-like body 11 of the intermediate panel is likewise situated in the guide path 3. The slide is located virtually in the center of the panel as long as the latter stands in the direction transverse to the rail. The more the panel 1 extends in the direction of rail 3, the more the pin will move toward an edge portion of the panel, this being furthered by the biasing force of the weight 19 on the slide 7. This movement relative to the panel is indicated with the arrow $P_3$ in FIG. 3. The movement of the slide within support members 9 and 10 is limited by the action of the weight which biases the slide to move toward a position where the point of attachment of member 20 is substantially directly over weight 20. In addition, slide 7 may engage a side edge of the associated panel. The pin and the slide 7 move to one standing hinged edge of the panel so that during further extension this hinged edge is automatically forced under the rails 3. In this way the panels are extended into the position of FIG. 2.

When the door is once again folded up, through swivelling of the free panel 1 in FIG. 2 the intermediate panel without guide member 2 will want to swivel with it. Owing to the free sliding of the slide 7 along the top side of the panel the slide 7 will, when a sufficient adjusting force is applied that is greater than the biasing force exerted by the weight 19, once again move back to the centre of panel 1.

The above described construction requires a robust hinge construction between each of the panels. A first embodiment of such a hinge construction is shown in FIGS. 5–10.

The hinge has seven hinge pins which run parallel to the hinged edge of the panels 1. The main hinge pins are designated with the numerals 22, 23, each of them being arranged on a hinge plate 24, 25. The hinge plates 24 and 25 are fixedly attached to the inner wall of a wall panel 6 by any suitable fastening means 26.

At the edge facing away from the hinge point 22 the hinge plates 24 and 25 have two bent over lips 27 between which are arranged a third and fourth hinge pin 28 and 29 respectively. These hinge pins 28 and 29 are connected for swivelling by way of a system of links 30, 31 and via the pins 32, 33 to hinge wings 34, 35 which are arranged above one another in a vertical direction. The hinge wing 34 has an angled shape and displays on the edge away from the pin 32 two slotted through-holes through which are placed bolts 36. These bolts 36 screw into an auxiliary wing 37 connected to the hinge pin 23. Hinge wing 35 has a similar angled shape and the edge remote from pin 33 has two slotted through-holes through which similar bolts 36 extend. These last-mentioned bolts screw into auxiliary wing 37' connected to the hinge pin 22. The auxiliary wings 37 and 37' are swivelly connected via a seventh hinge pin 39 to the respective auxiliary wings 37 and 37'. Such a seven-fold hinge has the advantage that an exact guiding of the panels with respect to each other remains ensured, even after long-term use, whereby the panels can be moved from the extended position into the retracted folded position, see FIG. 7 and FIG. 8 respectively, with the special feature that the hinge construction remains virtually wholly within the walls 6 of a panel 1.

Figure 6:
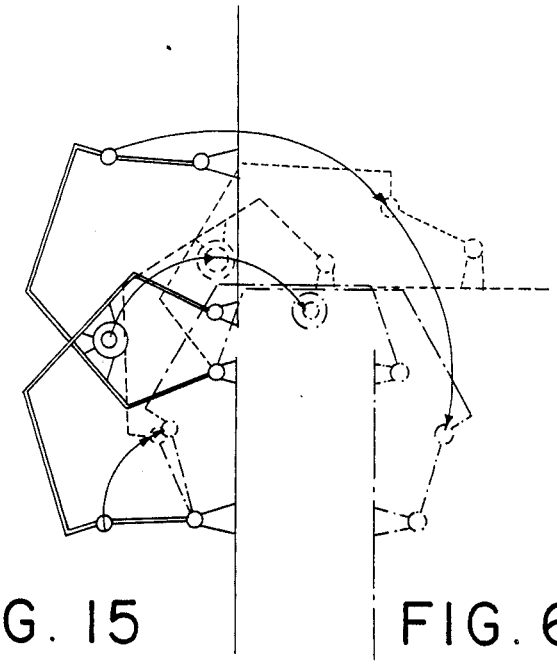
FIG. 6 shows a schematic outline of the movement mechanism from FIG. 5, FIG. 7 and 8 are top views of the hinge from FIG. 5 in respectively the straightened and folded position of the partition wall.
Figure 8:
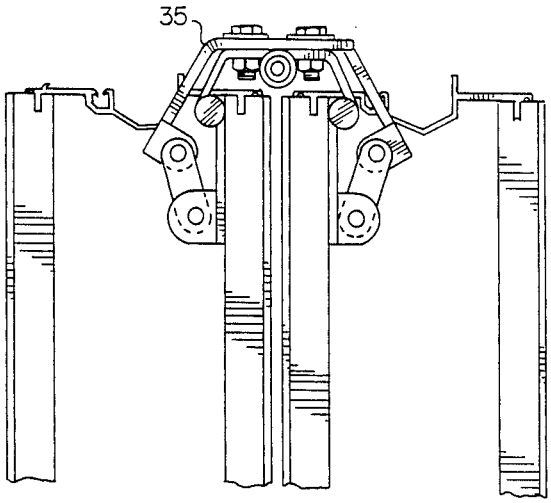
Figure 9:
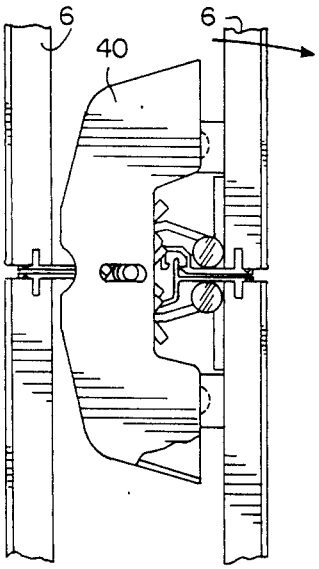
FIG. 9 and 10 are views corresponding to FIG. 7 and 8, whereby the hinge is protected by a cover.
Figure 10:
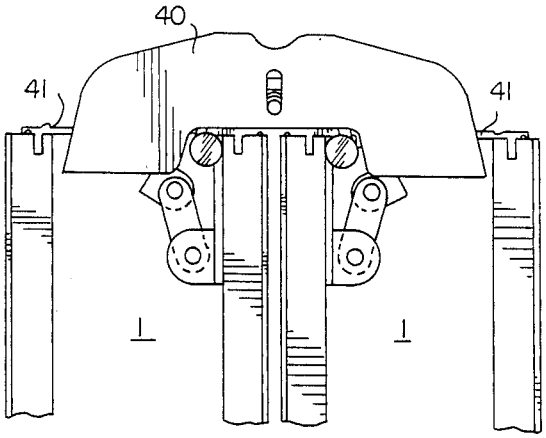

The swivelling movement of the different parts of the hinge system are indicated schematically in FIG. 6, whereby the full lines designate the stretched position of the panels, the bold broken lines designate the fully folded out position as in FIG. 8 and the fine broken line the intermediate positions.

Only in the completely folded open position in fig. 8 can each of the hinge wings 34 and 35 be seen, the free, folded portion thereof lying wholly on the top side of the panel. This gives the advantage that the fastening bolts 36 are very easily accessible from outside, which simplifies the fitting of the panels to each other. In each case a panel can be arranged at the correct height next to a hanging panel, following which only the wings 34, 35 are fastened to the adjoining hinge part by means of bolts 36, after the hinge pin 39 has fixed the auxiliary wings 37 and 38 to one another. The hinge can otherwise be mounted beforehand to the relevant panel, the final fitting of the door in the place of use is thus greatly facilitated. The slotted holes in the wings 34, 35 thereby ensure that the hinge can be set and readjusted in simple manner such that the vertical seam between successive panel elements has the required constant width dimension when the wall is situated in the folded out, flat position. Hangover and sagging of the panel elements as a result for instance of imprecise fitting, clearance as a result of form faults in the components or simply through wear, can be rectified in a simple manner both during and after installing of the wall as a result of this adjustment possibility.

Since the hinges are comparatively small they can easily be held in a covering cap 40 which fits entirely into the space between the walls 6 of a panel. The protective cap 40 protrudes moreover through a recess of a cover strip 41 on the top side of a panel 1. In this way the whole top side of a panel can be closed off completely.

Figure 11:
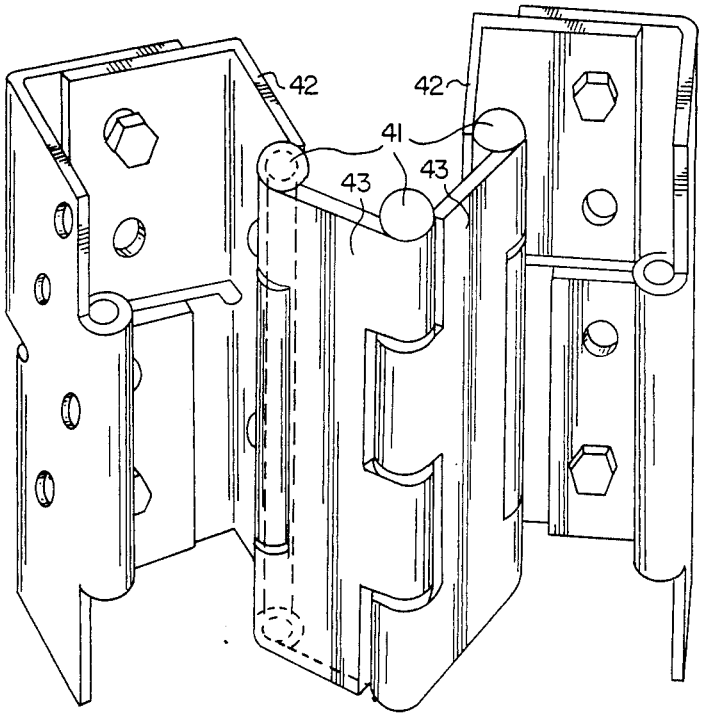
FIG. 11 is a perspective view of a second embodiment of the hinge suitable for a partition wall according to the invention.
Figure 7:
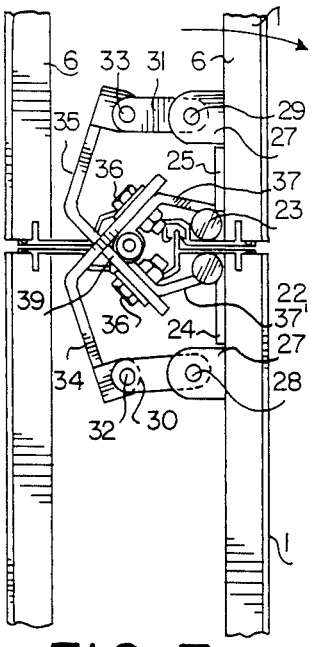
Figure 12:
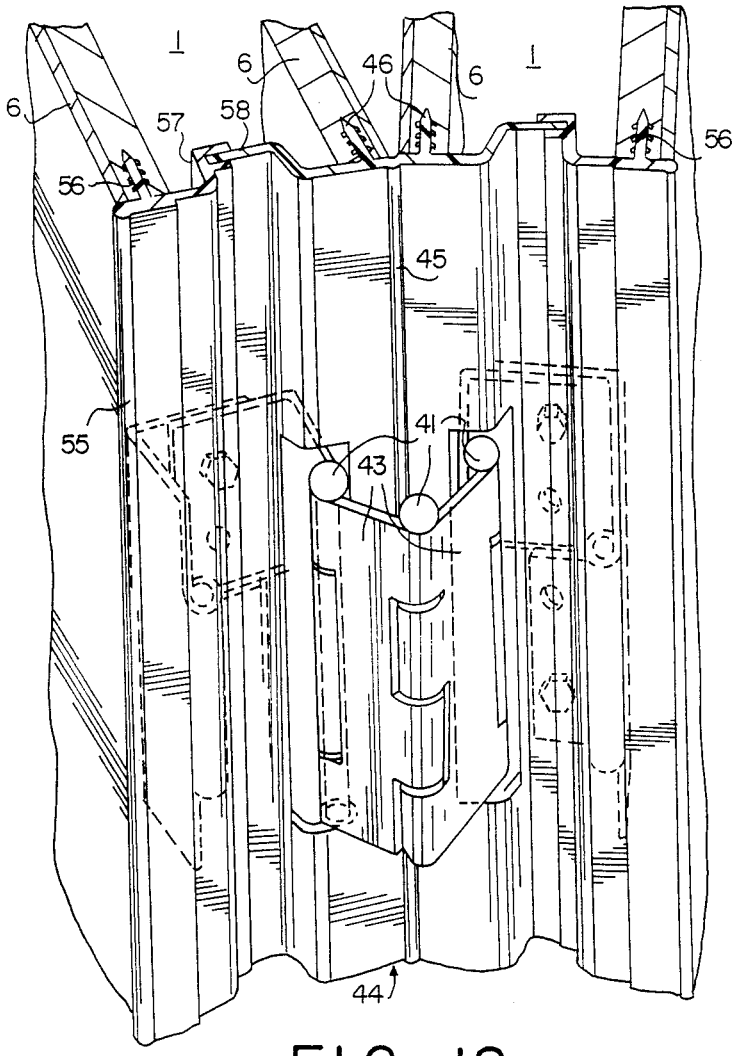
FIG. 12 is a view corresponding to FIG. 11 of the hinge in mounted position between two panel parts with covering strips.

A second embodiment of a hinge is shown in FIGS. 11 and 12.

Use is made in this embodiment of a hinge with three parallel hinge pins 41 and four mutually swivelling hinge plates 42, 43. The hinge plates 42 are fixed on the inside of a wall portion 6 of a panel 1. This attachment can be carried out in various ways. Use is also made in this embodiment of a continuous plastic hinge 44 with a hinge line 45, this hinge being provided with resilient fastening portions 46 which are inserted into grooves in the top side of each panel wall portion 6. A precise hinging movement thus results at the standing edge of the panel 6, whereby the force transfer can take place via the assembled hinge as in FIG. 11.

In this particular embodiment use is also made of spacer elements between the wall portions 6 of panel 1. These spacer elements are shown in the FIGS. 13, 14 and 15, and preferably consist of a plate 47 bent into an L-shape, whereby the one plate portion simultaneously forms the hinge plate 42 of the hinge shown in FIG. 11. To this end this plate portion is provided with a sleeve-like edge part 48 for receiving the hinge pin 41. The holes 49 serve for passage of fastening means, for example bolts, which are screwed into the wall 6.

The other portion of plate 47 consists of two body plate portions 50 in staggered position relative to one another. The actual spacer element is formed by two plates 47, which are entirely identical in form and which when assembled with one plate turned through an angle of 18° relative to the other plate form a unit of generally U-shaped cross-section, which can be seen in FIG. 15. This has the advantage that holes 52 arranged in the body plate portion 50 can serve as the mounting side accessible from the top side of the panels, so that the screw bolt 53 can easily be screwed into a nut part 54 on the rear of the left-hand body plate portion. By maintaining accurate dimensioning not only is simple fitting ensured but also the plane-parallel position of the wall portions 6 of a panel 1.

Due to the identical form of the plates 47, the hinge as in FIG. 11 can also be formed in simple manner by arranging the hinge plates 43 between two adjacently positioned spacer elements of two adjoining panels, see FIG. 12.

The top side of the panels can be further covered off by an additional plastic covering strip 55 which can be inserted in a groove of the wall portion 6 with a conventional resilient fastening portions 56 in a manner similar to resilient fastening portions 46. The covering strip 55 has an F-shaped flanged portion 57 into which can be inserted the free edge 58 of the hinge strip 45.

The invention is not limited to the above described embodiments.

The biasing means for the movable guide means may comprise a gas spring, spiral spring, or the like, rather than a weight.

Figure 15:
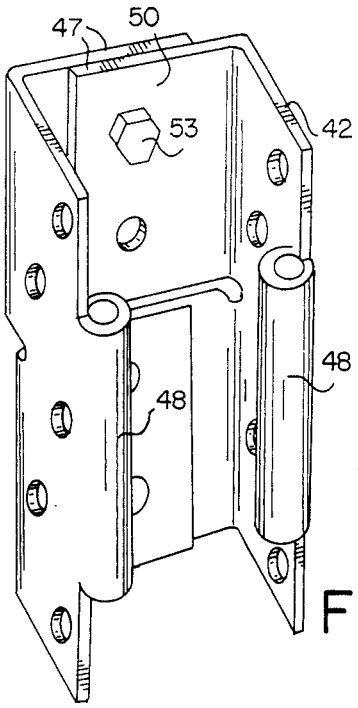
FIG. 15 shows the spacer element as in FIG. 13 in mounted position.
Figure 13:
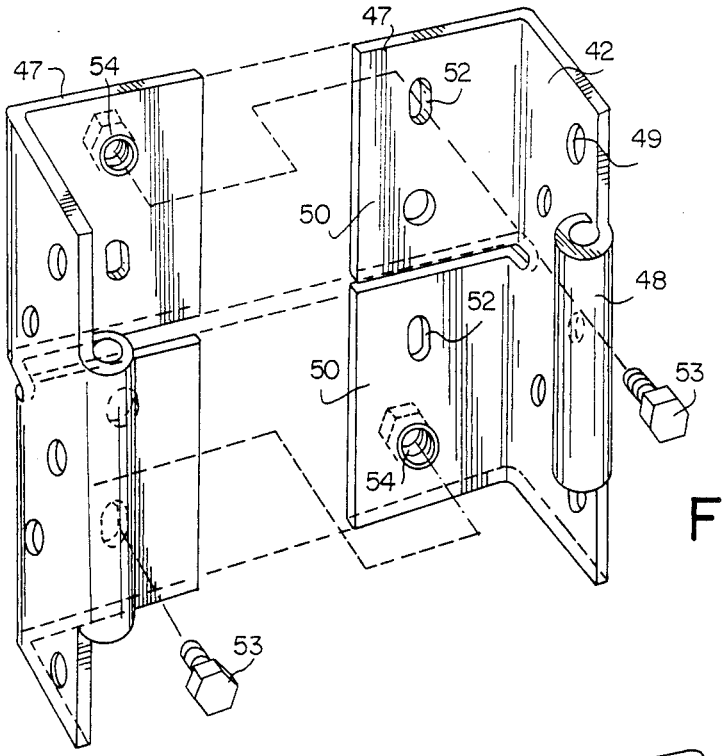
FIG. 13 and 14 show perspective views of two embodiments of spacer elements between the walls of a panel.
Figure 14:
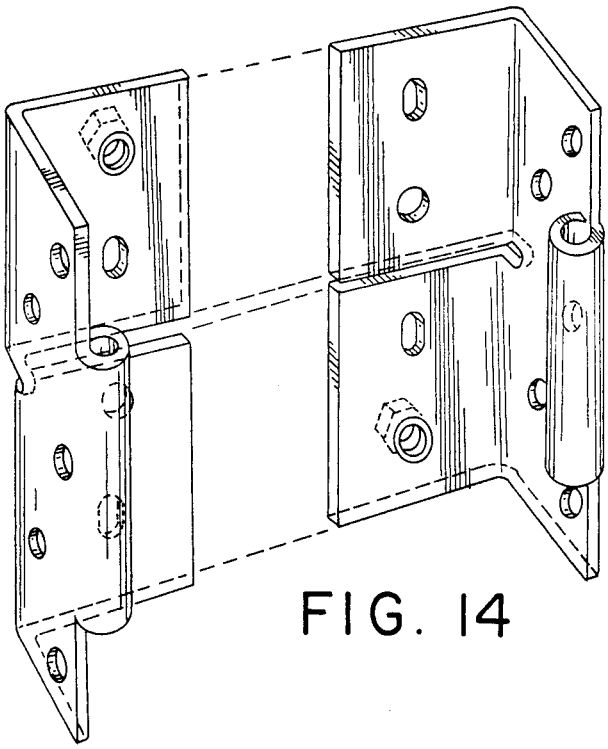

The spacer means shown in the FIGS. 13–15 can also be embodied without hinge sleeves 48.

I claim:

1. A partition wall for an opening comprising a plurality of panels movable between an extended closed position and a retracted open position, said panels having spaced opposite walls and including upper and lower edges connected by opposite side edges, adjacent panels having adjacent side edges thereof pivotally connected to one another, a guide rail disposed above and adjacent the upper edges of said panels, a pair of alternate panels each having a guide member disposed substantially at the center portion of the upper edge thereof and extending upwardly therefrom for engaging said guide rail, an intermediate panel disposed between said alternate panels and pivotally interconnected therewith, said intermediate panel including movable guide means extending upwardly from the upper edge thereof for engaging said guide rail, said guide means being movable toward and away from one of the side edges of said intermediate panel, and biasing means biasing said guide means toward said one side edge.

2. A partition wall as defined in claim 1 wherein said rail includes a downwardly facing slot formed therein, said guide member and said guide means being received within said slot for guiding movement of said panels.

3. A partition wall as defined in claim 1 wherein said guide means is movable along a path substantially parallel with the upper edge of said intermediate panel.

4. A partition wall as defined in claim 3 including a slide, said guide means being carried by said slide, and support means on said intermediate panel adjacent the upper edge thereof for supporting the slide for movement along said path.

5. A partition wall as defined in claim 4 including wheel means connected to said slide, said support means including a pair of spaced members carried by said intermediate panel for engaging said wheel means.

6. A partition wall as defined in claim 4 including a guide wheel supported by said slide and being rotatable about a substantially vertical axis, said guide wheel engaging the spaced opposite walls of said intermediate panel.

7. A partition wall as defined in claim 4 wherein said biasing means includes weight means, and a flexible member connecting said weight means to said slide.

8. A partition wall as defined in claim 7 including pulley means supported between the spaced opposite walls of said intermediate panel, said flexible member being trained over said pulley means.

9. A partition wall as defined in claim 1 wherein the opposite walls of each of said panels have a width, the interconnected panels including an end panel adapted to be disposed adjacent an edge of an opening to be closed by the partition wall, said end panel having a width less than that of the adjacent panel.

10. A partition wall for an opening comprising a plurality of panels movable between an extended closed position and a retracted open position, said panels having spaced opposite walls and including upper and lower edges connected by opposite side edges, hinge means for pivotally connecting adjacent side edges of adjacent panels to one another, the hinge means between adjacent panels including a hinge assembly connected to one of said walls of each of said adjacent panels on the surface facing the opposite wall of the associated panel and being disposed at the side edge of the associated panel, each hinge assembly including elongated first, second and third hinge pins having longitudinal axes disposed in substantially parallel spaced relationship with respect to one another, the axes of said first and second hinge pins being fixed with respect to one another, and the axis of said third hinge pin being movable with respect to the axis of said second hinge pin, a hinge wing connected to the third hinge pin of each of said assemblies, each of said hinge wings being swingably connected with the first hinge pin of the other of said hinge assemblies.

11. A partition wall as defined in claim 10 including link means interconnecting said third hinge pin with said second hinge pin of each of said hinge assemblies.

12. A partition wall as defined in claim 10 wherein the hinge wings of the two assemblies on adjacent panels are vertically spaced from one another.

13. A partition wall as defined in claim 10 including an auxiliary wing pivotally connected to said first pin of each of said assemblies, the auxiliary wings of the two assemblies of adjacent panels being pivotally connected to one another by a further hinge means, the wing means of each of said assemblies being connected to the auxiliary wing of the other of said assemblies on adjacent panels.

14. A partition wall as defined in claim 13 wherein each of said hinge wings includes a portion which is connected to a portion of the associated auxiliary wing of the other of said assemblies, connecting means for connecting said hinge wing portions with said auxiliary wing portions, said portions of the hinge wings extending substantially perpendicular to the opposite walls of the associated panels when adjacent panels are in retracted folded position so as to provide ready access to said connecting means.

15. A partition wall for an opening comprising a plurality of panels movable between an extended closed position and a retracted open position, said panels having spaced opposite walls and including upper and lower edges connected by opposite side edges, hinge means for pivotally connecting adjacent side edges of adjacent panels to one another, the hinge means between adjacent panels including a pair of hinge plates, a first hinge pin pivotally interconnected said pair of hinge plates to one another, a pair of spacer means, a second hinge pin pivotally interconnecting one of said spacer means with one of said hinge plates, a third hinge pin pivotally interconnecting the other of said spacer means with another of said hinge plates, said first, second and third hinge pins being disposed in spaced substantially parallel relationship to one another, said spacer means being connected with surfaces of the walls of the associated panels which face the opposite walls of the associated panels at a side edge thereof, said spacer means each comprising a plurality of portions, and means interconnecting said portions of each of spacer means to one another.

16. A partition wall as defined in claim 15 wherein each of said spacer means portions includes a pair of swiveling hinge plates of generally L-shaped cross-sectional configuration interconnected with one another to form a spacer means of generally U-shaped cross-sectional configuration between the opposite walls of the associated panel.

17. A partition wall as defined in claim 16 wherein each of said swiveling hinge plates includes an integral sleeve-like edge part receiving a hinge pin therein.

18. A partition wall as defined in claim 16 wherein said spacer means portions have aligned openings therein, and bolts cooperating with said openings to secure the spacer means portions to one another.

* * * * *